United States Patent [19]

Lee

[11] 4,453,712

[45] Jun. 12, 1984

[54] DRIVE SYSTEM FOR TOY CARS

[75] Inventor: Cheuk-Ming Lee, Hong Kong, Hong Kong

[73] Assignee: The Refined Industry Company Limited, Hong Kong, Hong Kong

[21] Appl. No.: 400,321

[22] Filed: Jul. 21, 1982

[30] Foreign Application Priority Data

Jul. 27, 1981 [GB] United Kingdom ..... 8123130

[51] Int. Cl.[3] ..... A63F 9/14; A63H 17/36

[52] U.S. Cl. ..... 273/86 B; 446/455; 446/460

[58] Field of Search ..... 273/86 B; 46/262

[56] References Cited

U.S. PATENT DOCUMENTS 4,187,637 2/1980 Nielsen ..... 46/262

4,218,846 8/1980 Lahr ..... 273/86 B X 4,231,183 11/1980 Lahr ..... 46/262

*Primary Examiner*—Anton O. Oechsle

*Attorney, Agent, or Firm*—Townsend and Townsend

[57] ABSTRACT

A toy racing car for use on a slotless car racing track has to continue to be driven in the forward direction when the polarity of the driving current is reversed, the reversal causing a change in the direction of steering of the car so that it can change from one lane to another. Such cars need to have a simple and reliable drive system. This drive comprises a drive pinion rotated by the motor, a slide mounted transversely of the axis of rotation of the drive pinion and slidable between limit positions in that transverse direction relatively to the axis of rotation of the drive pinion, a tooth upstanding from the slide and capable of engagement with the drive pinion for moving the slide from one limit position to the other according to the direction of rotation of the pinion, a pair of crown gears slidable longitudinally of the axis of rotation of the drive wheels and parallel to the direction of movement of the slide, flanges forming part of the crown gears which project into respective recesses in the slide, whereby movement of the slide from one limit position to the other moves the pinions along the axle, so that in one limit position of the slide the output pinion meshes with one crown gear to drive the car in the forward direction and when the slide is moved to the other limit position upon reversal of the direction of rotation of the drive pinion, the other crown gear meshes with the drive pinion to continue to drive the car in the forward direction despite the change in direction of rotation of the motor.

11 Claims, 7 Drawing Figures

DRIVE SYSTEM FOR TOY CARS

This invention relates to toy racing car sets. In particular, the invention relates to the drive system for the toy cars in such sets.

BACKGROUND TO THE INVENTION

Various forms of toy racing car sets are known where an endless track is provided and electrically driven cars under the control of individual operators are raced against one another around the track. There are two main systems. The first is often known as slot racing since the track is provided with a slot and a corresponding pin projects down from underneath the car into the slot and guides the car around its defined lane of the track. The other system is known by contrast as slotless racing and each car is not constrained to follow a particular lane but can swap from one lane to another. The invention relates specifically to cars for use in the slotless car racing system.

In a slotless car racing system, the car is provided with contacts which bear against continuous electrical conductors embedded in the surface of the track and in this way the car's motor receives power to drive it along. Normally two sets of three parallel strips of conductors are provided to define two lanes around the track. In this way one car can receive power from two of the conductor strips, whether it be positioned in one or other lane, whilst a second car can receive power from the third conductor strip and one of the other two conductor strips in common with the first car, again irrespective of the lane it is following.

There are various ways of causing a car remotely to switch from one lane to the other. The most common uses a change in the polarity of the driving current to the motor to change the direction of rotation of the motor. A drive system is then provided between the motor and the driving wheels which ensures that the drive wheels continue to drive the car in the forward direction irrespective of the direction of the rotation of the motor. A change in the direction of the motor however can be used to control the direction in which the car veers or steers whether to the left or to the right so as remotely to change from one lane to the other according to the operator's wishes. In this way racing cars can follow a particular lane such as the inside lane at a bend but an operator can arrange for his car to move to the outer lane to overtake a slower car.

It is an object of the invention to provide an improved drive system between the motor and the rear wheels in such cars, the arrangement being simple in construction, reliable in operation and easy to assemble since previous drive systems have not been entirely satisfactory in these respects.

BRIEF SUMMARY OF THE INVENTION

According to the invention there is provided a toy racing car for use with a slotless car racing track in which a drive is taken from the motor to drive the car in the forward driving direction irrespective of the direction of rotation of the electric motor, the drive comprising a drive pinion rotated by the motor, a slide mounted transversely of the axis of rotation of the drive pinion and slidable between limit positions in that transverse direction relatively to the axis of rotation of the drive pinion, a tooth upstanding from the slide and capable of engagement with the drive pinion for moving the slide from one limit position to the other according to the direction of rotation of the pinion, a pair of crown gears slidable longitudinally of the axis of rotation of the drive wheels and parallel to the direction of movement of the slide, flanges forming part of the crown gears which project into respective recesses in the slide, whereby movement of the slide from one limit position to the other moves the pinions along the axle, so that in one limit position of the slide the output pinion meshes with one crown gear to drive the car in the forward direction and when the slide is moved to the other limit position upon reversal of the direction of rotation of the drive pinion, the other crown gear meshes with the drive pinion to continue to drive the car in the forward direction despite the change in direction of rotation of the motor.

Such a drive system is relatively simple to manufacture and assemble. Only a few parts are necessary and these can be sturdy so that the drive system can have a long reliable life.

The slide is provided with a single tooth which engages with the drive pinion. When this reverses its direction of rotation, it acts as a kind of rack causing the slide to move from one limit position to the other. In either limit position, the tooth is not driven any further by the drive pinion since it becomes disengaged from the pinion. However the tooth becomes re-engaged when the pinion reverses and drives the slide to the other limit position.

The change in direction of rotation of the drive motor is used to control the steering or the veering of the toy car. Thus in one embodiment the drive wheels are mounted on separate axles so that when one is driven the other free wheels. In this way the car tends to veer away from the wheel which is then being driven. By way of example if the left-hand side driving wheel is being driven and the right-hand side driving wheel is free wheeling, the car will veer to the right. In this embodiment, each driving wheel and its associated crown gear are mounted on their own sub-axle, the crown gear being rotatably fixed to the sub-axle whilst being capable of sliding longitudinally relative that axle.

In another embodiment the reversal of the direction of rotation of the motor can be used to change the direction of steering of steering wheels. In this embodiment the driving means can if desired both be mounted, together with the two crown gears, on a common axle so that they are both driven forwardly at all times. This is not essential however and instead separate sub-axles as described above can be provided to supplement any steering from the steering wheels.

The steering wheels can be articulated in one of the conventional manner for doing this, e.g. bogie steering or king-pin steering, and the steering driven in one direction or the other by engagement of another pinion in the output shaft of the motor with a toothed sector connected to a steering drive. In this way a positive drive between the teeth of the drive and the tooth sector pinion will cause the pinion to turn until the end of the toothed sector is reached whereupon the sector is resiliently maintained in this position but not forced beyond it since the drive pinion becomes disengaged, the turning of the toothed sector turning the steering drive and so the steering wheels. Upon reversal, the drive pinion is then re-engaged with the toothed sector which turns the steering in the other limit direction until the other end of the toothed sector is reached.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
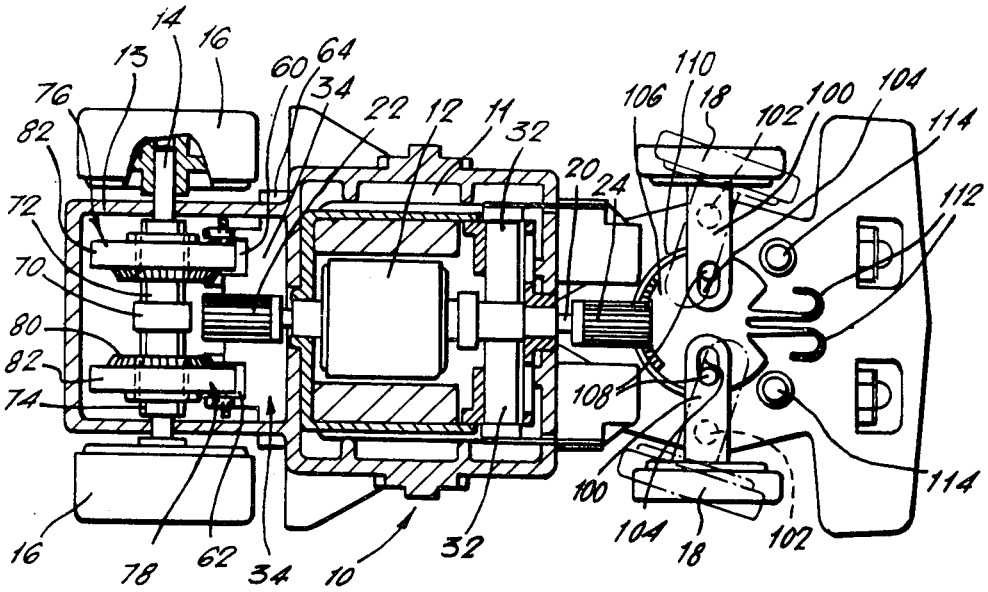
FIG. 1 is a plan view of a toy car according to the invention with the body removed.

The car 10 shown in the drawings has a chassis 11 on which is mounted an electric drive motor 12. Rotatably journalled through ribs 13 upstanding from the chassis is a rear drive axle 14 which at its outer ends carries a pair of rear driving wheels 16. Towards the front of the chassis are mounted steerable front wheels 18.

The electric motor has an output shaft 20 extending outwardly from either end. In the rearward direction a drive pinion 22 is fixed to the shaft while in the forward direction a similar drive pinion 24 is fixed to the shaft. The electric motor is a DC motor and so its direction of rotation depends upon the polarity of the voltage applied. Current pickups 26 in the form of copper strips are positioned underneath the chassis and bear resiliently down against the track. These pick up current from conductors flush with the surface of the track and the current is taken by wires not shown to the brushes 32 of the motor.

Slidably mounted in the transverse sense across the chassis is a slide 34. This slide is movable between limits where it engages the left-hand or the right-hand side rib 13. In FIG. 1 the slide is shown intermediate its two limit positions.

Figure 3:
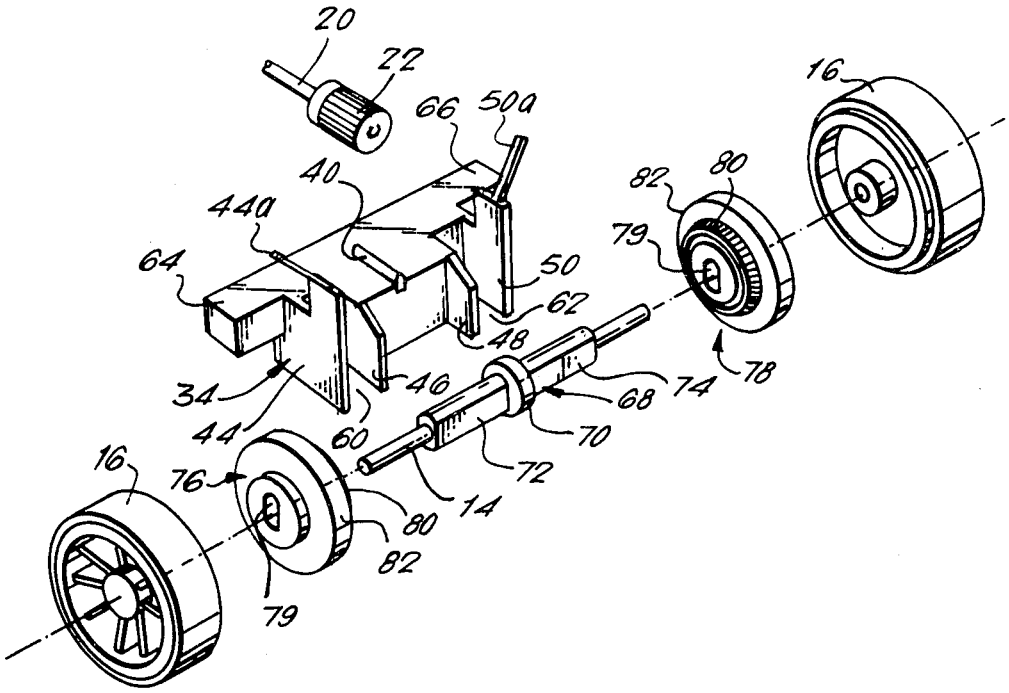
FIG. 3 is an exploded diagram showing the parts constituting the drive system between the electric motor and the driving wheels.

The slide is best shown in FIG. 3 and it includes an upstanding integral tooth 40 positioned to engage the pinion 22 and it further includes two rearwardly directed pairs of lugs 44, 46 and 48, 50. Between the respective pairs 44, 46 and 48, 50, recesses 60 and 62 are defined. Projecting outwardly from the ends of the slide are wings 64 and 66 and these are journalled in recesses not shown in the upstanding ribs 13 of the chassis and so guide the slide in its transverse movement. Upstanding from the lugs 44 and 50 are resilient fingers **44*a* and 50*a***.

Mounted on the rear axle 14 intermediate the drive wheels is a sleeve 68. This sleeve is rigidly fixed to the axle and so rotatable therewith. The sleeve includes a central boss 70 on either side of which are portions 72 and 74 where the sleeve has a flattened circle or substantially oval cross-section. Slidably mounted on these portions 72 and 74 are crown wheels 76 and 78. These crown wheels have a central opening 79 with a cross-section corresponding to the portions 72 and 74 and so the crown wheels are rotatably fixed relative their respective portion 72 or 74 but can slide longitudinally relative that portion. Each crown wheel includes a toothed crown gear 80, and a plain circular flange 82 projecting beyond the gear.

Figure 2:
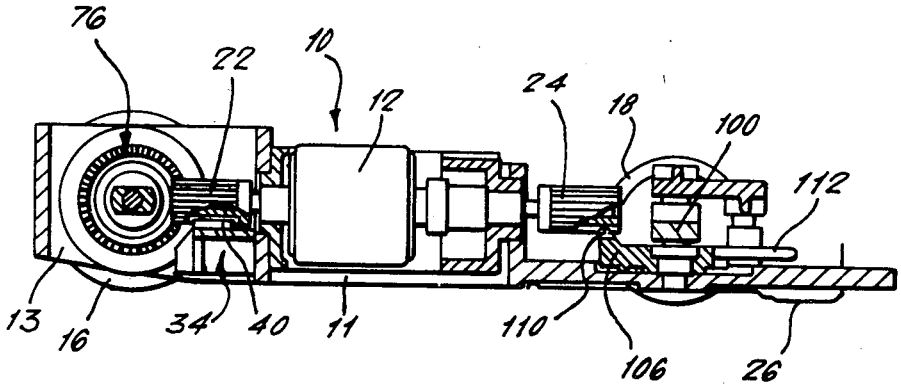
FIG. 2 is a sectional elevation.

When the various parts are all assembled as shown in FIGS. 1 and 2, the flanges 82 of the crown wheels fit within the respective recesses 60 and 62 of the slide. When the slide moves, it also moves the crown wheels 76 and 78 by engagement of the flanges 82 between the lugs 44, 46 and 48, 50, along their respective portions 72 and 74 of the sleeve. When the slide is in one limit position, one or other crown wheels 76 or 78 will be engaged with the pinion 22 and one or other lugs 44 or 50 will bear against the side of the chassis 13. The respective finger **44*a* or 50*a* will be at least partially flattened against the chassis and urge the slide away from that limit position against the action of the pinion 22 against the tooth 40**.

Looking at FIG. 1 and assuming that the drive shaft rotates in a clockwise direction as seen from the rear of the car, this direction of rotation will cause the slide to move to the left as seen from the rear of the car because of the engagement between the pinion 22 and tooth 40. Therefore the crown gear 78 will then be brought into engagement with the pinion 22 with the result that the axle 14 and both drive wheels 16 will rotate in a clockwise direction as viewed from the right hand side of the car. Thus the car moves forward.

When the direction of rotation of the motor is reversed, the finger **44*a* will urge the tooth 40 to become engaged with the teeth on the drive pinion and the slide will be driven to the right in the sense viewed from the rear of the car. This will move the crown gear 78 out of engagement with the pinion 22 but the crown gear 76 will instead be brought into engagement with the drive pinion 22. As will be appreciated, this will continue to drive the rear axle 14 and the drive wheels 16** in the forward direction despite the fact that the motor direction has now reversed.

As the slide approaches its limit position, the tooth 6 moves out of engagement with the driving edge of the teeth on the drive pinion and so does not prevent rotation of the drive pinion and motor. However, the tooth 40 will be immediately re-engaged should the direction of rotation of the motor be reversed to cause the slide to move to its other limit position.

When either crown gear 76 or 78 is engaged with the pinion 22, one or other side face of the boss 70 engages the gear and maintains optimum meshing with the pinion 22.

The arrangement using the slide for ensuring that the drive wheels continue to rotate in the forward direction irrespective of the direction of rotation of the electric motor is very simple and requires only a minimum of moving parts. All of these parts can however be very robust and so long lasting and equally the actual assembly of this drive system is relatively straightforward.

The front steering wheels 18 are rotatabley mounted on stub axles 100 and in turn these stub axles are pivotally mounted on upstanding king-pins 102 fixed to the chassis 11 at a position intermediate the ends of each stub axle. The inner ends of the stub axles are provided with elongated holes 104. A rotatable disc 106 is pivotally mounted on the chassis and has upstanding from it a pair of pins 108. These pins project into and engage in the elongated holes 104 in the stub axles. Also upstanding from the disc 106 is a toothed sector 110. The teeth of the sector engage with the teeth of the front drive pinion 24.

Projecting forwardly from the disc 106 are springs 112. These are arranged to contact upright pins 114 upstanding from the chassis.

When the motor rotates in one direction the teeth on the pinion 24 engage with the toothed sector and rotate the disc as far as the last tooth at that end of the sector. Once the disc has reached this position one of the springs 112 resiliently bears its respective pin 114. When the disc has been rotated in this way the engagement of the pins 108 in the elongated holes 104 of the stub axles 100 has caused them to rotate about the king-pins 102 so as to turn the steering wheels 18 in the left or right direction. The car thus steers to the left or to the right.

When the direction of rotation of the motor is reversed the springs 112 urge the toothed sector 110 into engagement with the drive pinion and the disc 106 is rotated to the opposite limit to the other end of the toothed sector. In turn, the steering wheels are turned in the opposite sense so as to steer the car in the opposite direction.

Figure 4:
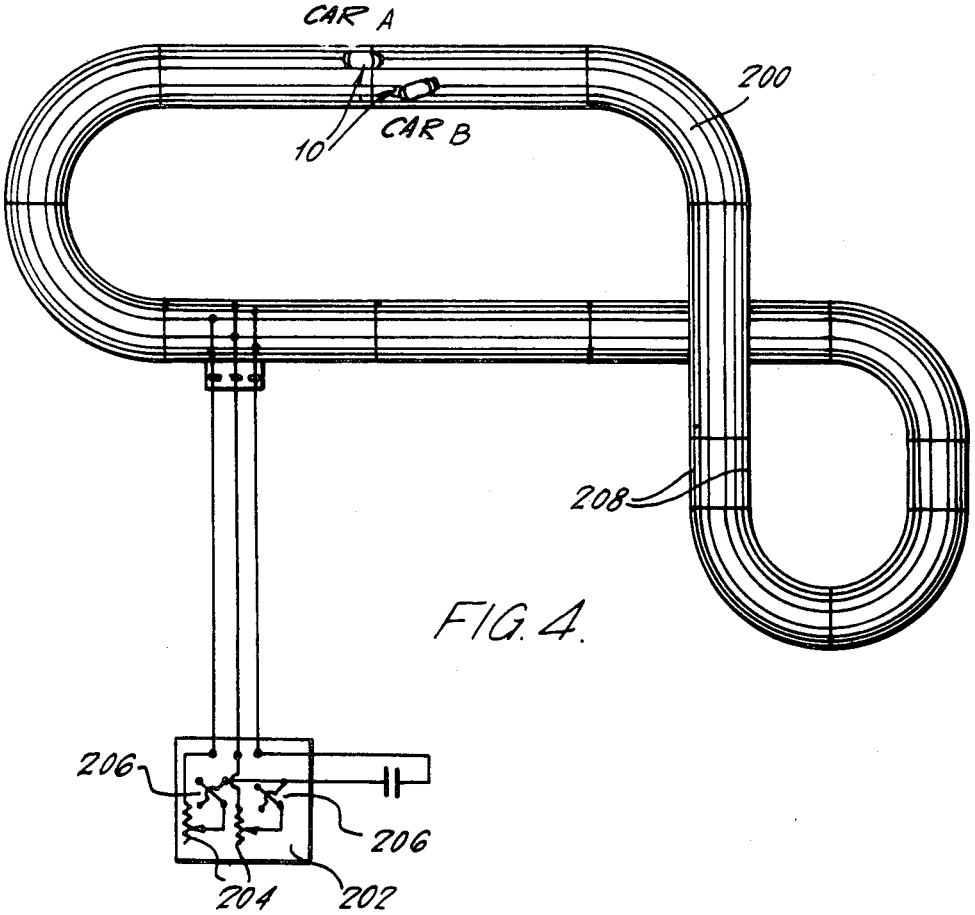
FIG. 4 is a diagram showing a car racing track on which cars according to the invention are being driven.

Cars 10 according to the invention can be used on a slotless racing track 200 as shown diagrammatically in FIG. 4. As can be seen the track 200 is made up of a number of sections and defined into a left-hand and a right-hand lane. In each lane are embedded three parallel conductor strips and the respective conductor strips of each lane are electrically connected. Two cars 10 according to the invention are as shown on the track. The pickups 26 of the car A could for example contact the central and left-hand conductor strips whilst the car B could be positioned to contact the central right-hand conductor strips.

A control box 202 is provided in which the speed of driving of the car is controlled by adjusting a resistance 204 for each car whilst the steering of each car to the left or to the right is controlled by a polarity reverse switch 206.

The track 200 has upstanding flanges 208 at its side edges. The car is steered to bear against these flanges so as to keep the car in its lane. When the steering direction is changed, the car crosses to the other lane and the bears against the other flange.

Figure 7:
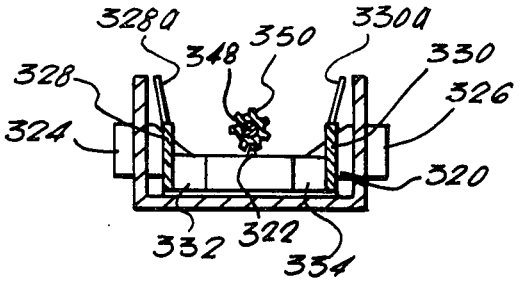
FIG. 7 is a sectional detail taken on the line 7—7 of FIG. 5.
Figure 5:
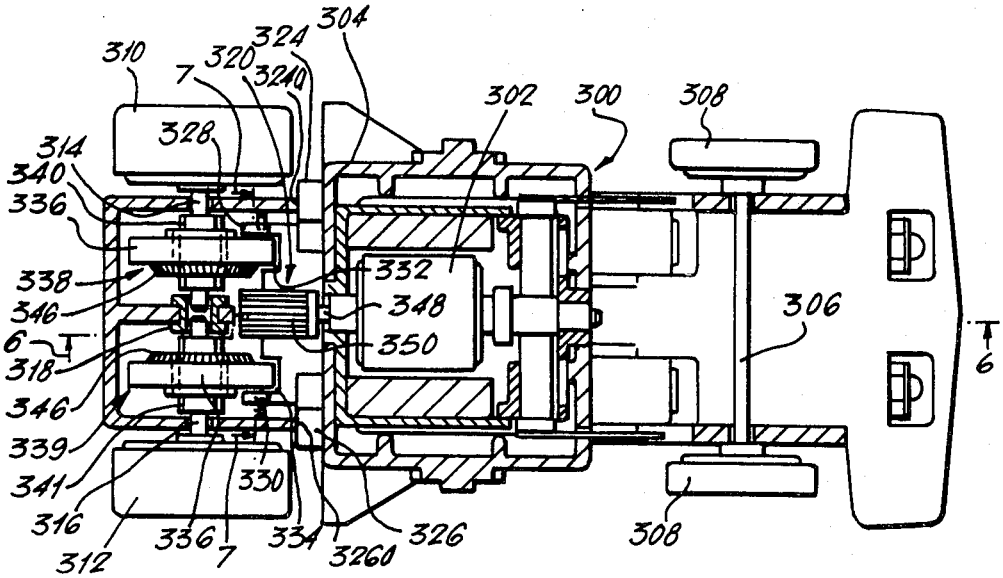
FIG. 5 is a plan view of an alternative embodiment of toy car according to the invention with the body removed.
Figure 6:
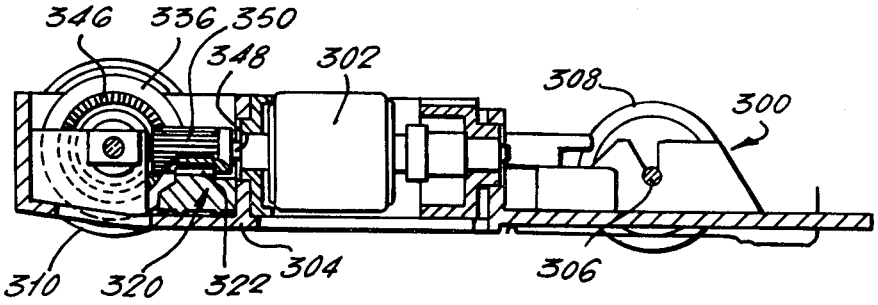
FIG. 6 is a sectional elevation taken on the line 6—6 of FIG. 5.

The toy car 300 shown in FIGS. 5 to 7 represents an alternative embodiment of the invention. In this car there is a drive motor 302 mounted on a chassis 304. Rotatably journalled in the chassis is a front axle 306 on which are mounted a pair of front wheels 308. As best seen in FIG. 5 these wheels are not steerable which is in contrast to the front steering wheels in the toy car 10 shown in FIGS. 1 to 3.

The rear wheels 310 and 312 of the car 300 are each independently mounted on sub-axles 314 and 316, respectively. These sub-axles are journalled near their outer ends in the chassis 304 and their inner ends are rotatably journalled in a sleeve 318 fixed to the chassis. Each sub axle can rotate independently of the other.

Slidably mounted transversely of the chassis and parallel to the sub axles 314 and 316 is a slide 320 which in many ways is similar to the slide 34. As best shown in FIG. 7 the slide includes an integral upstanding tooth 322 and a pair of integral side wings 324 and 326. These are slidably received in recesses **324*a* and 326*a* in the chassis and constrain the slide to move in its transverse direction across the chassis. The slide also has rearwardly directed lugs 328 and 330 from which are upstanding resilient fingers 328*a* and 330*a*. On the inward side of each of the lugs 328 and 330 are defined recesses 332 and 334 and into these recesses, and as best shown in FIG. 5, flanges 336 of a pair of crown gears 338 and 339** are received.

These crown gears 338 and 339 are more or less identical with the crown gears 76 and 78 shown in FIG. 1. Each crown gear is slidably mounted via corresponding flattened bores on respective flattened sleeves 340 and 341 fixed on the respective sub-axles 314 and 316. Therefore the crown gears 338 and 339 are rotatably fixed relative their respective sub-axles and driving wheels but are slidable longitudinally the sub axles. In addition, each crown gear has gear teeth 346 and the flanges 336 which are received in the recesses 332 and 334 of the slide 320.

The motor 302 has a rearwardly directed output shaft 348 on which is mounted a drive pinion 350. The latter engages one or other of the crown gears 338 or 339 as will be described below and the tooth 322 on the slide.

The driving arrangement for the car 300 is very similar to that described above in connection with the car 10. Thus, when the motor 302 rotates the pinion in one direction, e.g. a clockwise direction as seen from the rear of the car, it engages the tooth 322 on the slide and moves the slide to the left as seen from the rear. The slide moves until the lug 328 engages the chassis and the finger **328*a* is at least partially flattened. The finger therefore urges the slide to the right against the action of the driving of the pinion so that when the direction of rotation of the pinion is reversed, the pinion will immediately engage the tooth 322** and drive the slide to the right.

In moving to its leftmost limit position the slide entrains with it the crown gears 338 and 339. The crown gear 338 which drives the left-hand rear wheel 310 is disengaged from the pinion whilst the gear teeth 346 on the crown gear 339 driving the right-hand rear wheel 312 is brought into engagement with the pinion 350. As a result the left-hand rear wheel 310 free wheels and the right-hand wheel 312 is driven which causes the car to veer gradually to the left.

When the direction of rotation of the motor 302 is reversed, then the right-hand rear wheel 312 free wheels and the left-hand rear wheel 310 now drive the car so that it veers gradually to the right.

The car 300 of course can be used in an identical maner to the car 10 on track 200 as shown in FIG. 4.

Both the car 10 and the car 300 have very effective yet very simple driving mechanisms to enable the cars to be driven forward yet steered to the left or to the right. The mechanism driving the rear wheels including the slides 34 and 320 is simple and/or robust. Therefore, the drive is long lasting and relatively cheap to construct. Only a minimum of moving parts are used.

A latitude of modifications, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A toy racing car for use with a slotless car racing track comprising:

a body, a motor mounted on said body, drive wheels driven by said motor, drive means to transfer a drive taken from said motor to drive the car in the forward driving direction irrespective of the direction of rotation of said electric motor, wherein said drive means comprises:

a drive pinion rotated by said motor, a slide mounted transversely of the axis of rotation of said drive pinion and slidable between limit positions in the transverse direction relatively to the axis of rotation of said drive pinion, a tooth upstanding from said slide and capable of engagement with said drive pinion for moving said slide from one limit position to the other according to the direction of rotation of said pinion, a pair of crown gears slidable longitudinally of the axis of rotation of said drive wheels and parallel to the direction of movement of said slide, flanges forming part of said crown gears which project into respective recesses in said slide, whereby movement of said slide from one limit position to the other moves said crown gears longitudinally of the axis of rotation of said drive wheels and parallel to the direction of movement of said slide, so that in one limit position of said slide the output pinion meshes with one crown gear to drive the car in the forward direction and when said slide is moved to the other limit position upon reversal of the direction of rotation of said drive pinion, the other crown gear meshes with said drive pinion to continue to drive the car in the forward direction despite the change in direction of rotation of said motor.

2. A toy racing car as claimed in claim 1 in which the car includes:

steerable steering wheels and the reversal of the direction of rotation of the motor is used to change the direction of steering of the steering wheels.

3. A toy racing car as claimed in claim 1 in which the car includes:

steerable steering wheels and the reversal of the direction of rotation of the motor is used to change the direction of steering of the steering wheels, and second drive means to transfer a drive taken from the motor to steer the steerable wheels, the drive comprising an output pinion arranged to engage a toothed sector connected to the steering, so rotating the toothed sector to a limited extent upon reversal of the direction of rotation of the motor and altering the direction of steering.

4. A toy racing car as claimed in claim 1 in which the car includes:

steerable steering wheels and the reversal of the direction of rotation of the motor is used to change the direction of steering of the steering wheels, second drive means to transfer a drive taken from the motor to steer the steerable wheels, the drive comprising an output pinion arranged to engage a toothed sector connected to the steering, so rotating the toothed sector to a limited extent upon reversal of the direction of rotation of the motor and altering the direction of steering, and wherein said steering wheels are mounted for king-pin steering and the toothed sector is linked to turn the steering.

5. A toy racing car as claimed in any of claims 2 to 4 in which the drive wheels are mounted on a common axle together with the two crown gears, and one or other crown gear is driven to rotate the driving wheels in the forward direction at any one time.

6. A toy racing car as claimed in any of claims 1 to 4 in which the drive wheels are independently rotatable, one being driven at anyone time depending upon the direction of rotation of the electric motor and the other free wheeling so that the car tends to veer in a direction away from the wheel which is being driven.

7. A toy racing car as claimed in claim 6 in which each driving wheel and an associated crown gear are mounted on their own sub-axle, the crown gear being rotatably fixed to the sub-axle whilst being capable of sliding longitudinally relative that axle.

8. A toy racing car system comprising:

a track, electrical conductors embedded in the surface of said track to provide two sets of three parallel strips of conductors defining two lanes, upstanding edges on said track, two cars as claimed in any of claims 1 to 4 provided with electrical pickups to receive power from a respective pair of said conductor strips in either lane, means for applying a variable electrical power across said respective pair of strips to vary the speed of each car, and means to alter the polarity of the electrical power to cause a car to steer in an opposite direction so as to switch from one lane to another.

9. A toy racing car system comprising:

a track, electrical conductors embedded in the surface of said track to provide two sets of three parallel strips of conductors defining two lanes, upstanding edges on said track, two cars as claimed in any of claims 2 to 4 in which the drive wheels are mounted on a common axle together with the two crown gears, and one or the other crown gear is driven to rotate the driving wheels in the forward direction at any one time, said cars being further provided with electrical pickups to receive power from a respective pair of said conductor strips in either lane, means for applying a variable electrical power across said respective pair of strips to vary the speed of each car, and means to alter the polarity of the electrical power to cause a car to steer in an opposite direction so as to switch from one lane to another.

10. A toy racing car system comprising:

a track, electrical conductors embedded in the surface of said track to provide two sets of three parallel strips of conductors defining two lanes, upstanding edges on said track, two cars as claimed in any of claims 1 to 4 in which the drive wheels are independently rotatable, one being driven at any one time depending upon the direction of rotation of the electric motor and the other free wheeling so that the car tends to veer in a direction away from the wheel which is being driven, said cars being further provided with electrical pickups to receive power from a respective pair of said conductor strips in either lane, means for applying a variable electrical power across said respective pair of strips to vary the speed of each car, and means to alter the polarity of the electrical power to cause a car to steer in an opposite direction so as to switch from one lane to another.

11. A toy racing car system comprising:

a track, electrical conductors embedded in the surface of said track to provide two sets of three parallel strips of conductors defining two lanes, upstanding edges on said track, two cars as claimed in any of claims 1 to 4 in which the drive wheels are independently rotatable, one being driven at any one time depending upon the direction of rotation of the electric motor and the other free wheeling so that the car tends to veer in a direction away from the wheel which is being driven, and each driving wheel and associated crown gear are mounted on their own sub-axle whilst being capable of sliding longitudinally relative that axle, said cars being further provided with electrical pickups to receive power from a respective pair of said conductor strips in either lane, means for applying a variable electrical power across said respective pair of strips to vary the speed of each car, and means to alter the polarity of the electrical power to cause a car to steer in an opposite direction so as to switch from one lane to another.

* * * * *